US010472819B2

(12) United States Patent
Klein et al.

(10) Patent No.: US 10,472,819 B2
(45) Date of Patent: Nov. 12, 2019

(54) ISOLATION BLOCK, METHOD FOR SEALING A FLUTE OF A FLUTED METAL DECK, AND WALL AND DECK CONFIGURATION

(71) Applicant: Hilti Aktiengesellschaft, Schaan (LI)

(72) Inventors: Manfred Klein, Kaufering (DE); Christian Foerg, Lamerdingen (DE)

(73) Assignee: Hiiti Aktiengesellschaft, Schaan (LI)

( * ) Notice: Subject to any disclaimer, the term of this patent is extended or adjusted under 35 U.S.C. 154(b) by 0 days.

(21) Appl. No.: 15/848,724

(22) Filed: Dec. 20, 2017

(65) Prior Publication Data

US 2018/0171624 A1 Jun. 21, 2018

(30) Foreign Application Priority Data

Dec. 20, 2016 (EP) ..... 16205270

(51) Int. Cl.

| | |
|---|---|
| ***E04B 1/68*** | (2006.01) |
| ***E04B 2/74*** | (2006.01) |
| ***E04B 1/94*** | (2006.01) |
| ***E04B 5/26*** | (2006.01) |
| ***E04D 13/16*** | (2006.01) |
| *E04B 1/88* | (2006.01) |

(52) U.S. Cl.

CPC ..... *E04B 1/68* (2013.01); *E04B 1/947* (2013.01); *E04B 2/7409* (2013.01); *E04B 2/7411* (2013.01); *E04B 2/7414* (2013.01); *E04B 2/7457* (2013.01); *E04B 5/268* (2013.01); *E04D 13/1656* (2013.01); *E04B 1/88* (2013.01)

(58) Field of Classification Search

CPC ... E04B 1/68; E04B 1/88; E04B 1/847; E04B 2/7414; E04B 2/7411; E04B 2/7457; E04B 2/7409; E04B 5/268; E04D 13/1656

USPC ..... 52/284

See application file for complete search history.

(56) References Cited

U.S. PATENT DOCUMENTS

| | | | | |
|---|---|---|---|---|
| 6,023,806 | A * | 2/2000 | Dumlao | B63B 5/00 14/73 |
| 6,941,706 | B2 * | 9/2005 | Austin | E04D 13/004 52/302.3 |
| 7,497,056 | B2 * | 3/2009 | Surowiecki | E04B 2/7457 52/261 |
| 2005/0229503 | A1 | 10/2005 | Rotter | |

(Continued)

FOREIGN PATENT DOCUMENTS

| | | |
|---|---|---|
| CA | 2 711 659 | 2/2012 |
| EP | 3 056 625 | 8/2003 |

OTHER PUBLICATIONS

Extended European Search Report mailed in EP 16 20 5270 dated May 4, 2017.

*Primary Examiner* — Joshua J Michener
*Assistant Examiner* — James J Buckle, Jr.
(74) *Attorney, Agent, or Firm* — Grüneberg and Myers PLLC

(57) ABSTRACT

An isolation block is useful for sealing a flute of a fluted metal deck and a movement joint between the metal deck and an adjacent wall configuration. The isolation block includes a flute sealing portion adapted to snugly fit into one of the flutes of the fluted metal deck, a joint sealing portion for sealing a movement joint, and a corrugation sealing portion for sealing a corrugation between adjacent fluted deck elements or in one of the fluted deck elements.

11 Claims, 5 Drawing Sheets

(56) References Cited

U.S. PATENT DOCUMENTS

| | | | | |
|---|---|---|---|---|
| 2007/0033822 | A1* | 2/2007 | Reck | B26D 7/0006 33/566 |
| 2007/0175140 | A1 | 8/2007 | Giannos | |
| 2007/0283643 | A1 | 12/2007 | Surowiecki | |
| 2015/0007515 | A1* | 1/2015 | Stahi, Jr. | E04B 2/7411 52/232 |

* cited by examiner

ISOLATION BLOCK, METHOD FOR SEALING A FLUTE OF A FLUTED METAL DECK, AND WALL AND DECK CONFIGURATION

The present invention relates to an isolation block for sealing a flute of a fluted metal deck and a movement joint between the metal deck and an adjacent wall configuration.

BACKGROUND OF THE INVENTION

Additionally, the invention is about a method for sealing a flute of a fluted metal deck and a movement joint between the metal deck and an adjacent wall configuration, wherein a wall plane of the wall configuration is oriented substantially perpendicular to a flute axis, and wherein the wall configuration comprises a ceiling runner being mounted on a lower side of the fluted metal deck.

Furthermore, the invention concerns a wall and deck configuration comprising a fluted metal deck and a wall configuration, wherein a wall plane of the wall is oriented substantially perpendicular to a flute axis of the fluted metal deck.

Fluted metal decks are known in the art. Very often, they are used in combination with wall configurations, especially drywall configurations. In this case, a ceiling runner is attached to the underside of the metal deck and a floor runner is attached to the floor. Between those two runners, studs are mounted in a way that a relative movement between the ceiling runner and the studs is permitted in a vertical direction. The studs, the ceiling runner and the floor runner form a frame to which gypsum boards can be attached in order to build a drywall configuration.

Usually, a defined movement joint is left between the lower side of the metal deck and the upper edges of the gypsum boards.

In order to provide a deck and wall configuration which is air-tight, sound-attenuating or even sound-proof, fire-resistant, fire-retardant, intumescent, smoke-proof and/or thermally isolating, the flutes of the metal deck, the small corrugations between fluted metal deck elements and the movement joint have to be sealed.

This is especially important for fire rated walls.

According to the state of the art, mineral wool is stuffed into the gaps mentioned above from both sides of the wall and subsequently coated, e. g. with a sprayable coating which acts as a smoke stopper.

The process of sealing involves several working steps and thus is cumbersome. Moreover, it involves working with mineral wool. As this material can cause skin irritation, workers have to put on protective clothing when in contact with mineral wool.

Furthermore, the quantity of mineral wool filled into the gaps and the quality of performing this work is heavily dependent on the person fulfilling this task. The result is a variation in the sealing quality.

Applying the spray coating represents an additional working step. Since the gypsum boards are already installed at the time the coating is being applied, the spray needs to be applied from both sides of the wall. This is time consuming for an operator having to perform this task.

Several attempts have been made to improve this situation.

In this context, CA 2 711 659 discloses fire stop blocks acting as thermal barriers in walls being built in combination with fluted metal decks. The geometry, i.e. shape and depth, of the fire stop blocks is adapted to the geometry of the flutes to be sealed. The process of sealing then includes slidably inserting the fire stop blocks into the flutes and spraying into the gaps a flexible firestop material such as polyurethane foam. The fire stop blocks are preferably made of cementitious material.

US 2015/0007515 A1 discloses isolation blocks made of mineral wool. The isolation blocks correspond to the geometry of the gaps to seal and thus comprise at least a portion having a geometry corresponding to the flutes of a fluted metal deck. Those isolation blocks can be installed before or after installation of the gypsum boards. Preferably, one isolation block is installed from each side of the wall.

The object of the invention is to further improve the sealing of fluted metal decks and associated movement joints between the metal deck and adjacent wall configurations. Thereby especially the disadvantages mentioned above shall be avoided.

BRIEF DESCRIPTION OF THE INVENTION

The invention provides an isolation block of the type mentioned above, comprising a flute sealing portion adapted to snugly fit into one of the flutes of the fluted metal deck, a joint sealing portion adapted to seal a movement joint, and a corrugation sealing portion adapted to seal a corrugation between adjacent fluted deck elements or in one of the fluted deck elements. In this context, the corrugations are sometimes referred to as baby flutes. Thus, such an isolation block can securely seal a fluted metal deck towards a wall configuration. The isolation block can be inserted between the wall and the fluted deck in one single working step and thus isolate two rooms with respect to fire, heat, air and sound. Due to the different portions of the isolation block, no further sealing activities are necessary. Consequently, the sealing is of high quality and can be performed with a minimum of manual work. These advantages are especially relevant for fire-rated walls which need to be sealed with special attention. The isolation block which is pre-manufactured, can be mounted before or after the installation of gypsum boards of a drywall configuration. When mounting the insulation blocks before the gypsum boards, which is preferred, the mounting operation is particularly easy because the space between the ceiling runner and the fluted metal deck is accessible from two sides and from underneath. The isolation block may also be referred to as a top of wall joint. Furthermore, it is preferred to install isolation blocks form both sides of a wall in order to seal a wall configuration to a deck. Thereby, the isolation blocks can be used for different wall thicknesses by leaving a gap between them.

In an embodiment of the invention, the flute sealing portion has a generally trapezoidal cross section when seen in a mounted state along a horizontal axis, wherein a top surface and two side surfaces of the flute sealing portion are adapted to be compressed against a corresponding wall section of one of the flutes respectively, and wherein a bottom surface of the flute sealing portion being opposed to the top surface, is substantially parallel to the top surface. The horizontal axis mentioned above corresponds to a flute axis of the flutes of the fluted metal deck. The geometry of the flute sealing portion corresponds to the geometry of the flutes and thus provides a reliable sealing effect. The compression of the flute sealing portion is achieved when slidably inserting the isolation block into the gap created by the flutes. The sealing operation, thus, is easy to perform.

The joint sealing portion can have a substantially rectangular cross section, preferably with rounded corners or having a conical shape, when seen in mounted state along a horizontal axis and can be attached to the bottom surface of the flute sealing portion. The horizontal axis, again, corresponds to a flute axis of the flutes of a fluted metal deck. The geometry of the joint sealing portion thus corresponds to the geometry of the movement joint between the fluted deck and the wall configuration. Consequently, the joint sealing portion is just inserted into this movement joint. Additional steps of shaping or reshaping the isolation block are not necessary.

Preferably, the joint sealing portion is shorter than the flute sealing portion in a direction along the horizontal axis and protrudes over the flute sealing portion on at least one side, preferably on both sides, when seen in cross section. Alternatively, the joint sealing portion maybe also of the same thickness as the flute sealing portion in a direction along the horizontal axis. The isolation block thus has the general form of an inverted T, whereas the horizontal bar is the joint sealing portion and the vertical bar is the flute sealing portion. The joint sealing portion preferably protrudes over the flute sealing portion by essentially half the width of a flute on each side. This shape of the isolation block allows providing a plurality of adjacent isolation blocks sealing a certain wall length to a fluted metal deck. One isolation block seals one flute, essentially half the width of a flute to the left of it and essentially half the width of a flute to the right of it. Consequently, the isolation blocks can be used in a modular way. Preferably, the joint sealing portion has a thickness in the direction along the horizontal axis which in principle corresponds to a thickness of a gypsum board used therewith. All in all, a tight sealing of the wall configuration to a fluted deck is provided.

In a further embodiment, the corrugation sealing portion has a generally triangular cross section, which in principle corresponds to the shape of the fluted deck corrugation, when seen in mounted state along a horizontal axis. The horizontal axis corresponds to a flute axis of the fluted deck. By the corrugation sealing portion, corrugations being part of fluted deck elements or appearing in a transition region between two fluted deck elements can be tightly sealed. The sealing takes place when inserting the isolation block between the wall configuration and the deck, thus it is very efficient in terms of installation time and effort.

The corrugation sealing portion may be attached to the portion of the joint sealing portion protruding over the flute sealing portion, and the corrugation sealing portion and the flute sealing portion may be attached on the same side of the joint sealing portion. All the elements of the isolation block thus form one single piece. This makes it possible to achieve outstanding sealing results by just slidably inserting one single element into the gap between the wall configuration and the deck.

The isolation block according to the invention can be produced as one integral part, preferably from an air-tight, sound-attenuating or even sound-proof, fire-resistant, fire-retardant, intumescent, smoke-proof and/or thermally isolating material, preferably from a polyurethane foam material. The isolation block thus is prefabricated and delivered to the construction site. Forming or shaping of the isolation block on-site is not necessary.

Furthermore, the invention provides an isolation block of the type mentioned above, comprising a flute sealing portion adapted to snugly fit into one of the flutes of the fluted metal deck, and a joint sealing portion adapted to seal a movement joint, wherein the isolation block is made of a generally resilient material comprising at least one reinforcement element. The reinforcement element can be made from metal or any other suitable stiff material. The reinforcement element can comprise one or more fixation openings which are filled by the surrounding resilient material, e. g. polyurethane foam. Thus, the reinforcement element is securely positioned and fixed in the isolation block. By the reinforcement element, selected portions of the isolation block can be reinforced, i.e. the resilience can be reduced locally.

In an embodiment, the isolation block comprises a corrugation sealing portion adapted to seal a corrugation between adjacent fluted deck elements or in one of the fluted deck elements. The corrugations thereby can be sealed securely.

Preferably, the reinforcement element is a planar element having a length oriented along the joint sealing portion and a width oriented perpendicular to its length, wherein the reinforcement element is preferably a flat strip. When the isolation block is mounted between a wall configuration and a fluted deck, the joint sealing portion essentially extends along the gap between the wall configuration and the deck, e. g. from left to right. The reinforcement element extends in the same direction. The width of the reinforcement can vary over its length, allowing to easily adjust its stiffness. As an alternative to a planar element, the reinforcement element can also be a wire element, preferably a wavy wire element. Such wire elements are easy to manufacture or to source on the market.

The width of the reinforcement element can be oriented vertically or horizontally when seen in a mounted condition of the isolation block. In case the reinforcement element is a flat strip, it can be oriented vertically, i.e. parallel to a wall, or horizontally, i.e. parallel to a deck. Intermediate positions are also possible depending on the specific case of application.

In a variant, the isolation block comprises one single reinforcement element which extends generally from one end of the joint sealing portion to the other end thereof when seen in mounted state along a horizontal axis. Thus, the joint sealing portion is reinforced with respect to the rest of the isolation block.

In another variant, the isolation block comprises two reinforcement elements, wherein each reinforcement element is located in a portion of the joint sealing portion protruding over the flute sealing portion. Thus, the area being close to the flute sealing portion is not reinforced, but the areas sealing the wall configuration to the deck are. Thereby, a secure sealing of the wall configuration to the fluted deck is achieved.

Advantageously, a portion of the reinforcement element protrudes from the isolation block and is adapted to be positioned on or against a ceiling runner of the wall configuration, when assembled. Thereby, a predetermined compression of the isolation block can be achieved. Additionally, the isolation block is positioned in a predetermined way relative to the wall configuration. Both effects lead to a high quality sealing between the wall configuration and the deck.

In another embodiment, the reinforcement element is an angled element having two legs, wherein in a mounted state one leg is preferably oriented vertically and the other leg is preferably oriented horizontally. Such a reinforcement element is particularly stable and/or stiff.

In an alternative embodiment, at least one portion of the reinforcement element is curved. By curving a portion of the reinforcement element, it can be adapted to the geometry of a given gap and/or provide a predetermined compression force to parts of the isolation block.

The invention also provides a method of the type described above, comprising the following steps:

a) plugging one or more isolation blocks according to the invention into a gap between the ceiling runner and the deck and b) subsequently mounting one or more gypsum boards.

Such a method is easy to perform. Additional working steps in order to seal a wall configuration to a fluted metal deck are not necessary. As the isolation blocks are mounted before the gypsum boards, the gaps can be accessed very easily which makes the mounting quick and easy.

In an embodiment, the gypsum board is flapped into the wall plane during step b) and compresses at least a portion of the isolation block into the wall plane. The portion of the isolation block thus is compressed in a horizontal direction by squeezing it between a gypsum board and a ceiling runner. Thereby a very secure sealing between the gypsum boards and the isolation block is achieved.

In an alternative embodiment, the gypsum board is brought into the wall plane during step b) and is subsequently slid towards the fluted deck, wherein the gypsum board compresses at least a portion of the isolation block against the fluted deck. When installing the gypsum board, the isolation block thus is squeezed between the fluted metal deck and an upper edge of the gypsum board. A particularly tight sealing is achieved thereby.

Preferably, the isolation block comprises at least one reinforcement element of which at least a portion protrudes from the isolation block, the protruding portion of the reinforcement element being brought into engagement with the wall configuration by compressing the isolation block during step b). Thus, by mounting the gypsum boards, the reinforcement is brought into engagement with the wall configuration, especially a ceiling runner. Thereby, a predetermined compression of the isolation block is achieved.

Additionally, the invention provides a wall and deck configuration as described above, wherein at least one isolation block according to the invention is positioned between the fluted metal deck and the wall, thereby sealing at least one flute of the fluted metal deck and a movement joint between the metal deck and an adjacent wall configuration. Such a wall and deck configuration provides an especially good sealing with respect to air, sound, fire, smoke and/or heat.

Different embodiments of the invention are shown in the attached drawings.

DETAILED DESCRIPTION OF THE INVENTION

Figure 1:
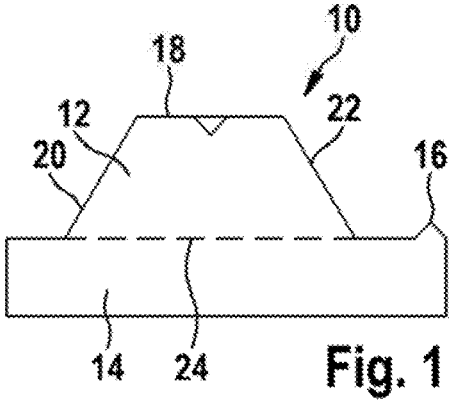
FIG. 1 shows a front view of an isolation block according to an embodiment of the invention.
Figure 2:
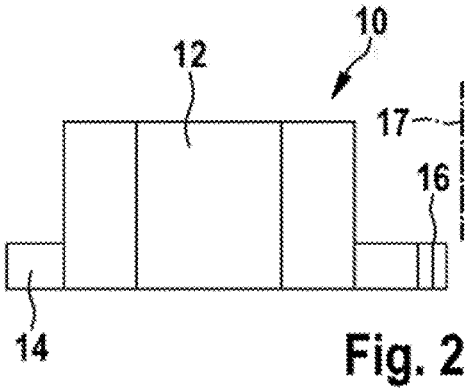
FIG. 2 shows a top view of the isolation block of FIG. 1.
Figure 3:
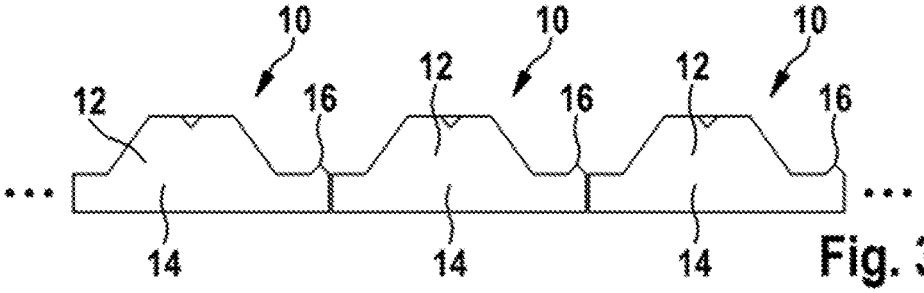
FIG. 3 shows a plurality of isolation blocks of FIGS. 1 and 2.

FIGS. 1 and 2 show an isolation block 10 comprising a flute sealing portion 12, a joint sealing portion 14 and a corrugation sealing portion 16.

The flute sealing portion 12 has a generally trapezoid cross section when seen in mounted state along a horizontal axis 17, which corresponds to the perspective taken in FIG. 1. It comprises a top surface 18, two side surfaces 20, 22 and a bottom surface 24 which is opposed to the top surface 18 and substantially parallel to it.

Figure 24:
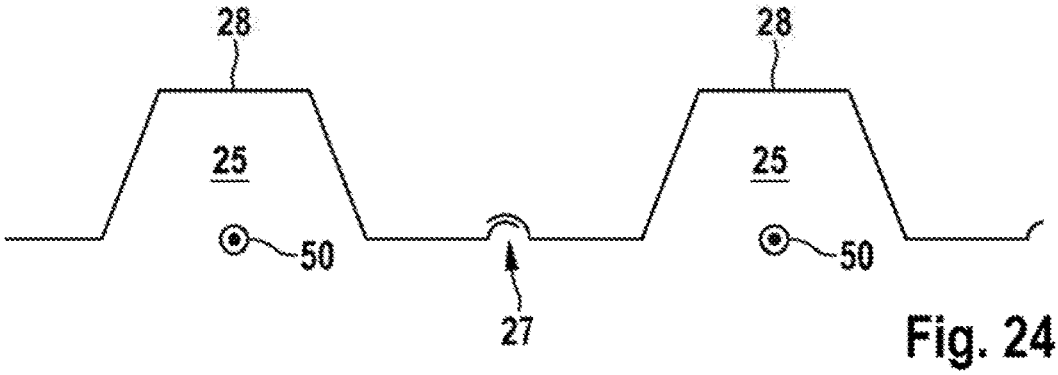
Figure 25:
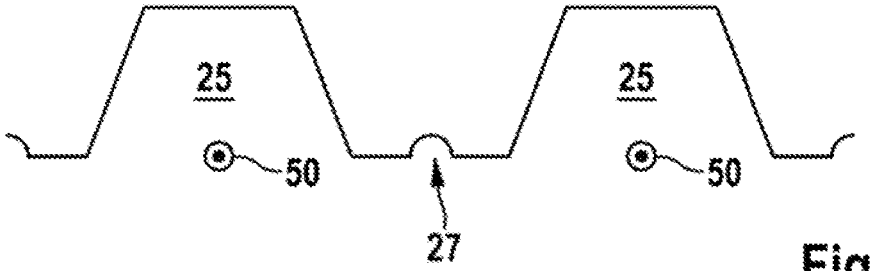

The flute sealing portion 12 is adapted to snugly fit into a flute 25 of a fluted metal deck (cf. FIGS. 24 and 25). Therefore, the top surface 18 and the side surfaces 20, 22 are adapted to be compressed against a corresponding wall section of such a flute 25.

The joint sealing portion 14 is adapted to seal a movement joint 26 between a fluted metal deck and a wall configuration. This will be explained later with respect to FIGS. 20 to 23. The joint sealing portion 14 has a substantially rectangular cross-section, preferably with rounded corners or having a conical shape, when seen in mounted state along the horizontal axis 17.

The joint sealing portion 14 is attached to the bottom surface 24 of the flute sealing portion 12. As can be seen in FIG. 1, the joint sealing portion 14 protrudes over the sealing portion 12, preferably on both sides.

In a direction along the horizontal axis 17, the joint sealing portion 14 is shorter than the flute sealing portion 12 (cf. FIG. 2).

The corrugation sealing portion 16 is adapted to seal a corrugation 27 between adjacent fluted deck elements 28 or in one of the fluted deck elements 28 (see FIGS. 24 and 25) and has a generally triangular cross section when seen in mounted state along the horizontal axis 17, which is the perspective taken for example in FIG. 1.

The corrugation sealing portion 16 is attached to the portion of the joint sealing portion 14 protruding over the flute sealing portion 12. Additionally, the corrugation sealing portion 16 is attached on the same side of the joint sealing portion 14 as the sealing portion 12.

The isolation block 10 shown in FIGS. 1 to 23 is produced as one integral part, for example from polyurethane foam.

The isolation block 10 can also be produced from any other air-tight, sound-attenuating or even sound-proof, fire-resistant, fire-retardant, intumescent, smoke-proof and/or thermally isolating material.

The material from which isolation block 10 is made, is generally resilient.

The isolation blocks 10 are designed to be lined up in a modular way in order to seal a wall configuration to a fluted deck. By placing several isolation blocks 10 in a row, wall configurations of different length can be sealed (cf. FIG. 3).

FIGS. 4 to 18 show embodiments of the isolation block 10 comprising a reinforcement element 30.

Figure 4:
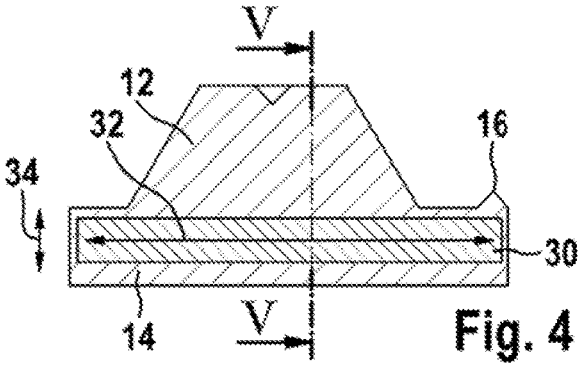
FIG. 4 shows an isolation block according to another embodiment of the invention in a cross sectional view IV-IV of FIG. 5
Figure 5:
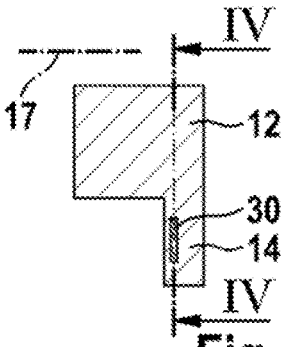
FIG. 5 shows the isolation block of FIG. 4 in a cross sectional view V-V of FIG. 4.

In the embodiment shown in FIGS. 4 and 5, the reinforcement element 30 is a planar element, e. g. a flat metal strip.

A length 32 of the reinforcement element 30 is oriented along the joint sealing portion 14 and extends generally from one end of the joint sealing portion 14 to the other one.

The reinforcement element 30 substantially is located in the joint sealing portion 14 of the isolation block 10.

A width 34 of the reinforcement element 30 extends in a vertical direction as can be seen in FIG. 5 for example.

Figure 6:
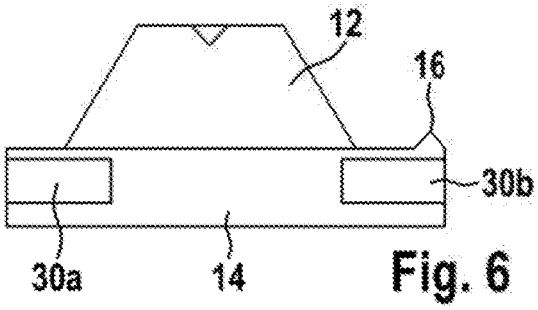
FIG. 6 shows an isolation block according to a further embodiment of the invention being an alternative to the isolation block of FIG. 4.

The embodiment shown in FIG. 6 is similar to the embodiment of FIG. 4, but comprises two reinforcement elements 30*a* and 30*b*. Thus, the reinforcement element 30 does not extend over the full length of the joint sealing portion 14 (cf. FIGS. 4 and 6).

The two reinforcement elements 30*a*, 30*b* are respectively located in a portion of the joint sealing portion 14 protruding over the flute sealing portion 12.

In the example shown, the reinforcement elements 30*a*, 30*b* also are flat metal strips.

Figure 7:
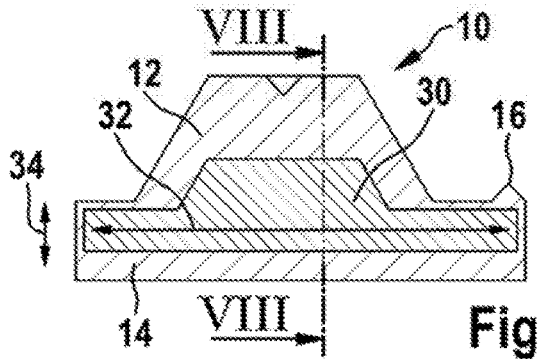
FIG. 7 shows an isolation block according to an additional embodiment of the invention in a cross sectional view VII-VII of FIG. 8.
Figure 8:
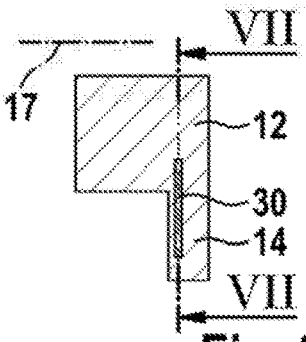
FIG. 8 shows the isolation block of FIG. 7 in a cross sectional view VIII-VIII of FIG. 7.

The embodiment according to FIGS. 7 and 8 shows a way to create a reinforcement effect which varies over the length 32 of the reinforcement element 30. To this end, in the embodiment shown, the width 34 of the reinforcement element 30 varies over its length 32.

Figure 9:
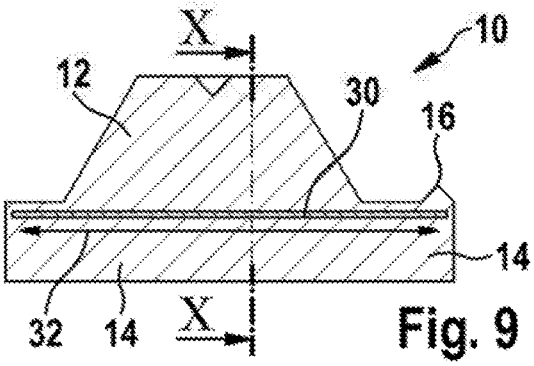
FIG. 9 shows an isolation block according to a further embodiment of the invention in a cross sectional view IX-IX of FIG. 10.
Figure 10:
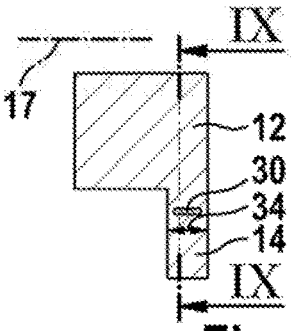
FIG. 10 shows the isolation block of FIG. 9 in a cross sectional view X-X of FIG. 9.

In the embodiment of FIGS. 9 and 10, the reinforcement element 30 again extends generally over the full length of the joint sealing portion 14.

In contrast to the other embodiments, the width 34 of the reinforcement element 30 now is oriented differently, i.e. in the direction of the horizontal axis 17.

Figure 11:
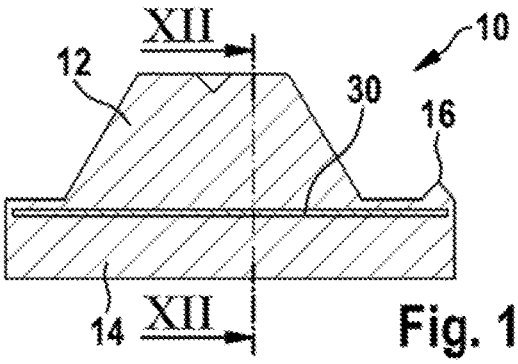
FIG. 11 shows an isolation block according to a supplementary embodiment of the invention in a cross sectional view XI-XI of FIG. 12.
Figure 12:
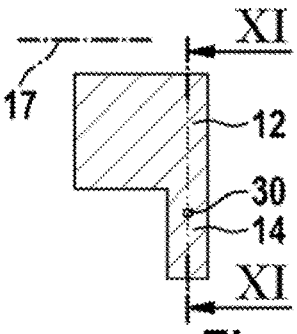
FIG. 12 shows the isolation block of FIG. 11 in a cross sectional view XII-XII of FIG. 11.

In embodiment of FIGS. 11 and 12 the reinforcement element 30 is made of a wire, a wire-like element or a bar with a substantially circular cross-section.

Figure 13:
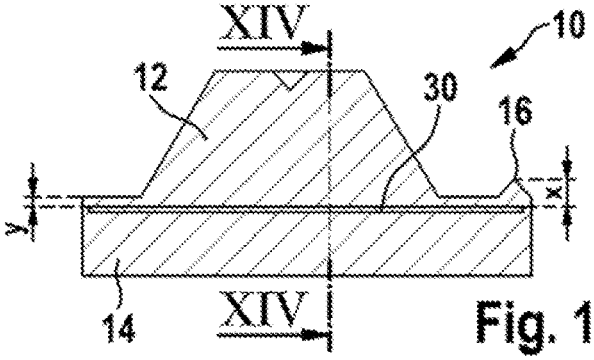
FIG. 13 shows an isolation block according to another embodiment of the invention in a cross sectional view XIII-XIII of FIG. 14.
Figure 14:
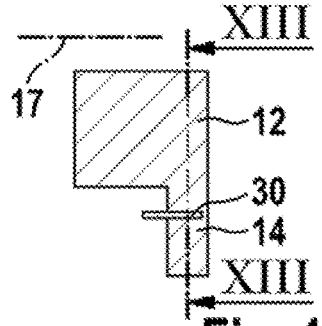
FIG. 14 shows the isolation block of FIG. 13 in a cross sectional view XIV-XIV of FIG. 13.

The embodiment according to FIGS. 13 and 14 is similar to the embodiment of FIGS. 9 and 10 with respect to the form and orientation of the reinforcement element 30.

The difference is that in the embodiment of FIGS. 13 and 14, the reinforcement element 30 protrudes from the isolation block.

By doing so, the reinforcement element 30 is adapted to be positioned on or between a ceiling runner and the fluted deck of a wall configuration as will be explained later with respect to FIGS. 22 and 23.

Figure 15:
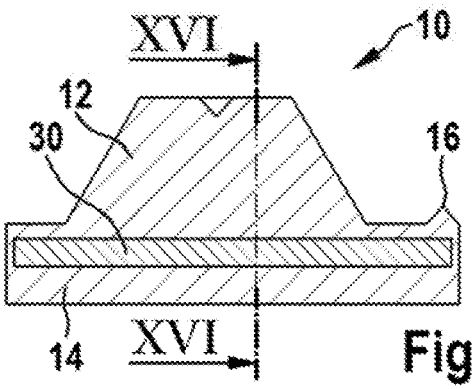
FIG. 15 shows an isolation block according to still another embodiment of the invention in a cross sectional view XV-XV of FIG. 16.
Figure 16:
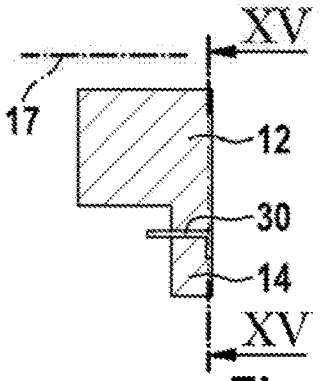
FIG. 16 shows the isolation block of FIG. 15 in a cross sectional view XVI-XVI of FIG. 15.

Also the reinforcement element 30 according to the embodiment of FIGS. 15 and 16 protrudes from the isolation block 10 in the same way the embodiment of FIGS. 13 and 14 does.

In contrast to the other embodiments, here the reinforcement element 30 is an angled element having two legs, with one of the legs being oriented horizontally, i.e. in the direction of the horizontal axis 17, and the other leg being preferably oriented perpendicular thereto.

It is also possible to use an angled reinforcement element 30 which does not protrude from the isolation block 10 (not shown).

Figure 17:
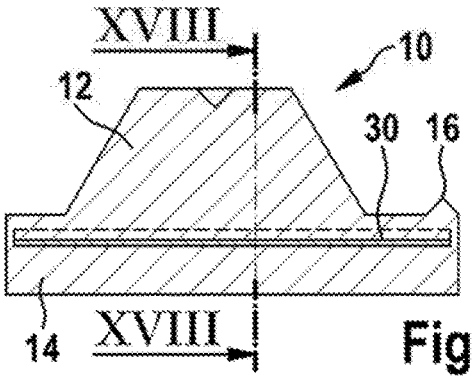
FIG. 17 shows an isolation block according to an additional embodiment of the invention in a cross sectional view XVII-XVII of FIG. 18.
Figure 18:
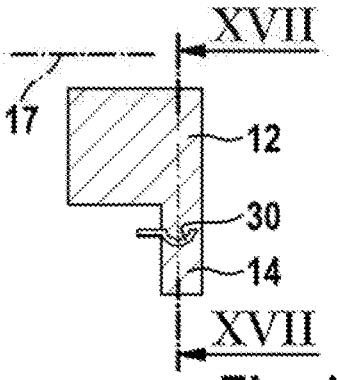
FIG. 18 shows the isolation block of FIG. 17 in a cross sectional view XVIII-XVIII of FIG. 17.

FIGS. 17 and 18 show an embodiment of the isolation block 10 in which the reinforcement element 30 has a form comprising a curved portion.

In the embodiment shown, the curved portion is the non-protruding portion of the reinforcement element 30.

Figure 19:
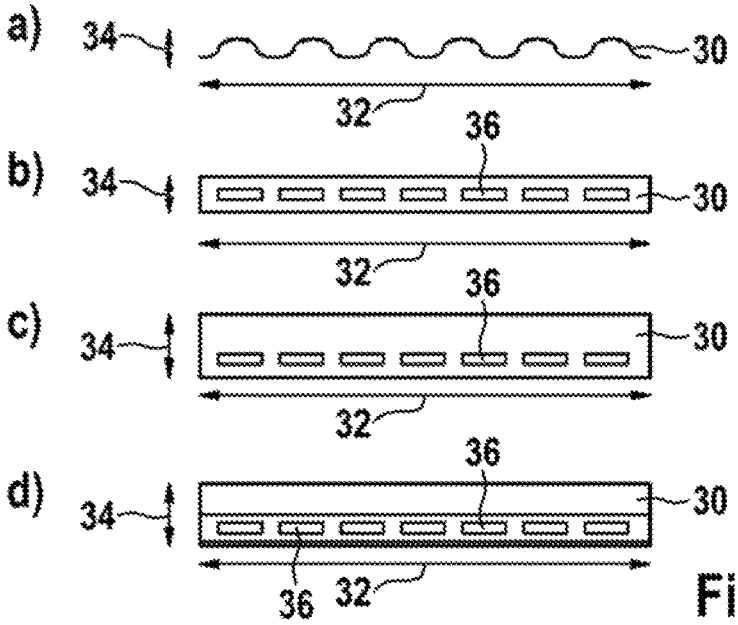
FIG. 19 shows a number of alternative reinforcement elements of an isolation block according to an embodiment of the invention.

In FIG. 19, different examples of the reinforcement element 30 are shown.

The reinforcement element 30 shown in FIG. 19 *a*) is a wavy wire and especially suitable for the embodiment of the isolation block 10 shown in FIGS. 11 and 12.

The reinforcement elements 30 according to FIGS. 19 *b*) and 19 *c*) can be used in the embodiments shown in FIGS. 4 to 6, 9, 10, 13, and 14.

The reinforcement elements 30 comprise fixation openings 36 which help securely fixing the reinforcement elements 30 inside the isolation block 10. In the assembled state, the material from which the isolation block 30 is made, fills the fixation openings 36.

FIG. 19 *d*) shows the reinforcement element 30 according to the embodiment shown in FIGS. 17 and 18. In this perspective also the fixation openings 36 can be seen.

FIGS. 20 to 23 show a wall and deck configuration 40 which is shown to be a drywall and deck configuration. The configuration 40 comprises a fluted metal deck 42 and a wall configuration 44.

In the example shown, the wall configuration 44 which defines a wall plane W, comprises a ceiling runner 46 being mounted on a lower side of the fluted metal deck 42 and two gypsum boards 48.

In all the embodiments, the wall plane W of the wall configuration 44 is positioned substantially perpendicular to a flute axis 50 of the fluted metal deck 42.

In the wall and deck configuration 40, one isolation block 10 is positioned between the fluted metal deck 42 and the wall configuration 44 from each side of the wall plane W. Thereby, the flutes 25 of the fluted metal deck 42 and the associated movement joints 26 towards the wall configuration 44 are sealed.

This wall and deck configuration 40 and especially the sealing of the flutes 25 of the fluted metal deck 42 and the associated movement joints 26 between the metal deck and wall construction is made as follows.

In a starting configuration, only the fluted metal deck 42 with the ceiling runner 46 fixed to it are present.

Then, in a first step, one or more isolation blocks 10 are plugged into a gap between the ceiling runner 46 and the deck 42. In the example shown, one isolation block 10 is plugged into such a gap from each side of the wall to be built.

Subsequently, one or more gypsum boards 48 are mounted. In doing so, they are fixed to the studs (not shown) and/or the studs of a floor assembly (not shown).

Figure 20:
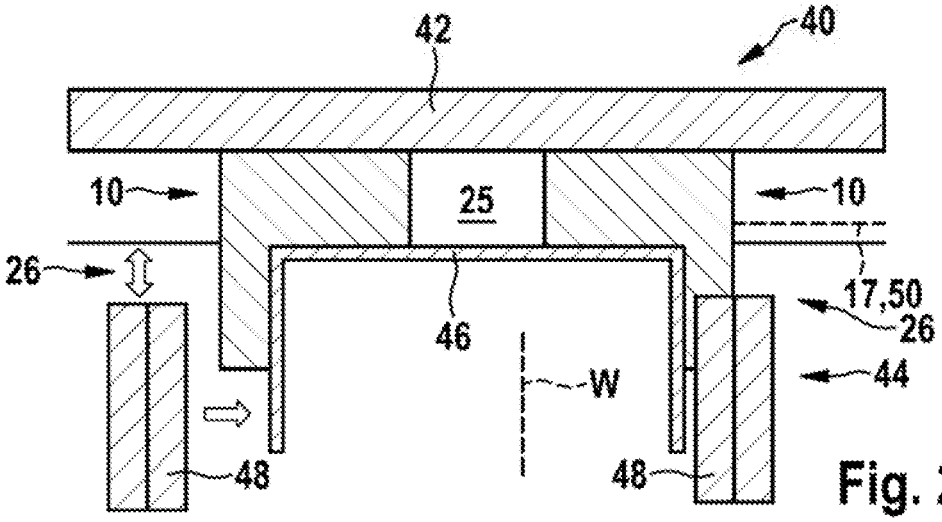
FIG. 20 shows a wall and deck configuration according to an embodiment of the invention.

In a first alternative which is shown in FIG. 20, the gypsum boards 48 are flapped into the wall plane, thereby compressing at least a portion of the isolation block 10 into the direction of the wall plane. The compressed portion of the isolation block 10 is part of the joint sealing portion 14.

Figure 21:
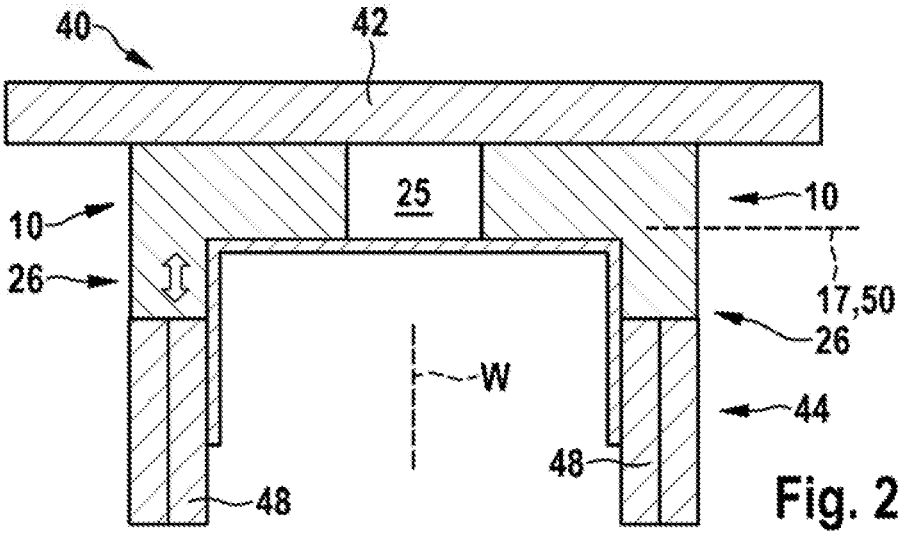
FIG. 21 shows a wall and deck configuration according to another embodiment of the invention.

A second alternative is to bring an upper portion of the gypsum board 48 in contact with the ceiling runner 46 and then slide it towards the fluted deck 42, thereby compressing at least a portion of the isolation block 10 against the fluted deck 42. This alternative is shown in FIG. 21.

Consequently, the isolation block 10 is compressed between the gypsum board 48 and the fluted deck 42. Preferably, in this alternative, the isolation block 10 is not compressed between the ceiling runner 46 and the gypsum board 48.

Figure 22:
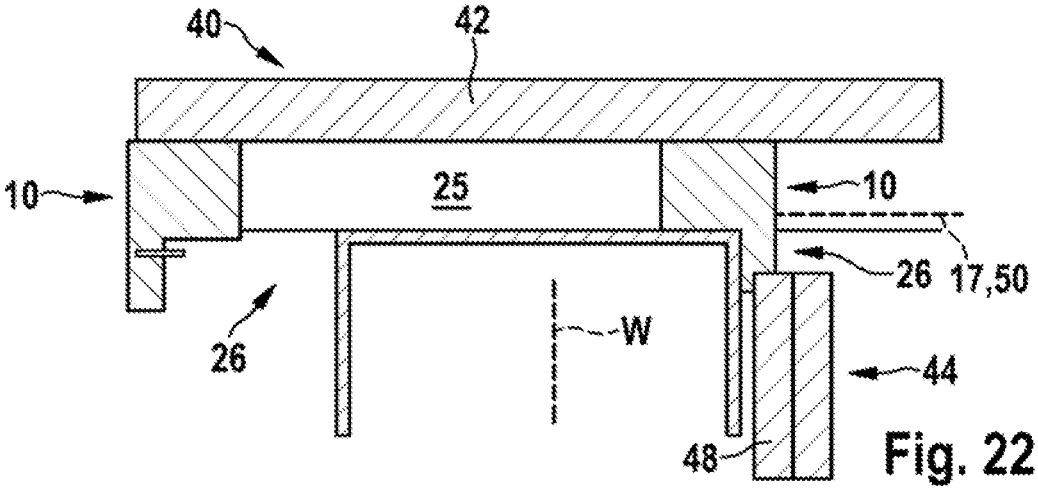
FIG. 22 shows a wall and deck configuration according to a further embodiment of the invention.
Figure 23:
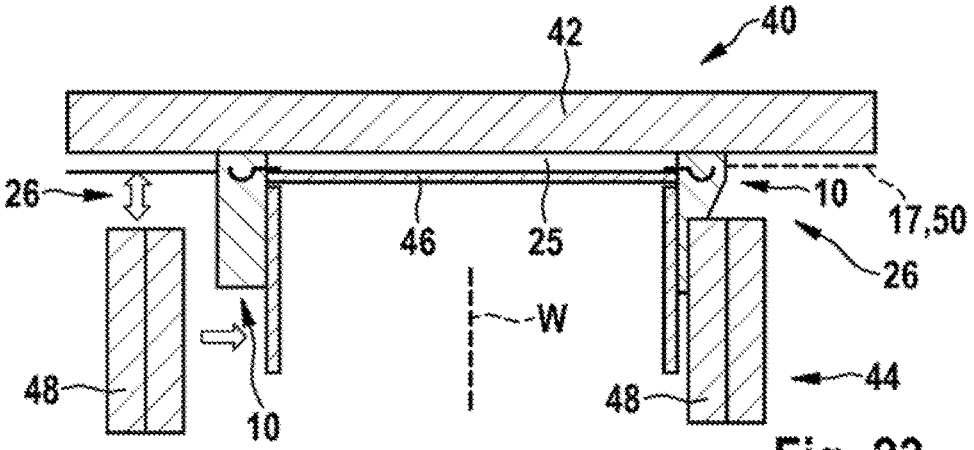
FIG. 23 shows a wall and deck configuration according to an embodiment of the invention, in the corrugation sealing portion area, FIG. 24 schematically shows two adjacent fluted deck elements of a wall and deck configuration according to an embodiment of the invention, and FIG. 25 schematically shows an alternative configuration of a fluted deck element of a wall and deck configuration according to another embodiment of the invention.

FIGS. 22 and 23 show embodiments of the wall and deck configuration 40 in which isolation blocks 10 with protruding reinforcement elements 30 are shown (see also FIGS. 13 to 18).

On the left hand side of FIG. 22, the isolation block 10 is shown in a non-compressed state. The corresponding compressed state can be seen on the rights side of the figure.

As explained before, the reinforcement element 30, more precisely its portion protruding from the isolation block 10, is adapted to be positioned on or between the ceiling runner 46 and the fluted deck 42. So, when mounting the gypsum board 48, the reinforcement element 30 prevents the isolation block 10 from moving out of the flute, in particular from moving downwards thereby creating an unwanted unsealed opening.

The same applies to the embodiment shown in FIG. 23 where the reinforcement element 30 is of a different shape.

The invention claimed is:

1. An isolation block for sealing a flute of a fluted metal deck and a movement joint between the metal deck and an adjacent wall configuration, the isolation block comprising a flute sealing portion having a shape corresponding with a shape of fluted deck corrugation to fit into one of the flutes of the fluted metal deck, a joint sealing portion adapted to seal a movement joint, and a corrugation sealing portion having a generally triangular cross section when seen in mounted state along a horizontal axis adapted to seal a corrugation between adjacent fluted deck elements or in one of the fluted deck elements.

2. The isolation block of claim 1, wherein the flute sealing portion has a generally trapezoid cross section when seen in mounted state along a horizontal axis, wherein a top surface and two side surfaces of the flute sealing portion are adapted to be compressed against a corresponding wall section of one of the flutes respectively, and wherein a bottom surface of the flute sealing portion, being opposed to the top surface, is substantially parallel to the top surface.

3. The isolation block of claim 2, wherein the joint sealing portion has a substantially rectangular cross section, when seen in mounted state along the horizontal axis, and is attached to the bottom surface of the flute sealing portion.

4. The isolation block of claim 3, wherein the joint sealing portion is shorter than the flute sealing portion in a direction along the horizontal axis and protrudes over the flute sealing portion on at least one side, when seen in cross section.

5. The isolation block of claim 1, wherein the corrugation sealing portion is attached to the portion of the joint sealing portion protruding over the flute sealing portion, and wherein the corrugation sealing portion and the flute sealing portion are attached on the same side of the joint sealing portion.

6. The isolation block of claim 1, which is produced as one integral part.

7. A method for sealing a flute of a fluted metal deck and a movement joint between the metal deck and an adjacent wall configuration wherein a wall plane of the wall configuration is positioned substantially perpendicular to a flute axis 44 and wherein the wall configuration comprises a ceiling runner being mounted on a lower side of the fluted metal deck, the method comprising the following steps:

a) plugging one or more isolation blocks of claim 1 into a gap between the ceiling runner and the deck and b) subsequently mounting one or more gypsum boards.

8. The method of claim 7, wherein the gypsum board is flapped into the wall plane during step b) and compresses at least a portion of the isolation block into the wall plane.

9. The method of claim 7, wherein the gypsum board is brought into the wall plane during step b) and subsequently is slid towards the fluted deck, and wherein the gypsum board compresses at least a portion of the isolation block against the fluted deck.

10. The method of claim 7, wherein the isolation block comprises at least one reinforcement element of which at least a portion protrudes from the isolation block, and wherein the protruding portion of the reinforcement element is brought into engagement with the wall configuration by compressing the isolation block during step b.

11. A wall and deck configuration, comprising a fluted metal deck and a wall configuration, wherein a wall plane of the wall configuration is positioned substantially perpendicular to a flute axis of the fluted metal deck, and wherein at least one isolation block of claim 1 is positioned between the fluted metal deck and the wall configuration, thereby sealing at least one flute of the fluted metal deck and a movement joint between the metal deck and an adjacent wall configuration.

* * * * *